United States Patent [19]

Flippin

[11] 4,103,441

[45] Aug. 1, 1978

[54] TRENCHER WITH OFFSET DRIVE WHEELS

[75] Inventor: James Samuel Flippin, Clearwater, Kans.

[73] Assignee: J. I. Case Company, Racine, Wis.

[21] Appl. No.: 794,953

[22] Filed: May 9, 1977

[51] Int. Cl.[2] ..... E02F 5/06

[52] U.S. Cl. ..... 37/86; 16/35 R; 280/47.11

[58] Field of Search ..... 37/86, 90, 94; 280/79.1, 47.11; 16/35 R

[56] References Cited

U.S. PATENT DOCUMENTS

| | | | |
|---|---|---|---|
| 2,828,557 | 4/1958 | Brown | 37/90 |
| 2,846,786 | 8/1958 | Barber et al. | 37/86 |
| 2,997,276 | 8/1961 | Davis | 37/86 X |
| 3,828,392 | 8/1974 | Bolger | 16/35 R |

*Primary Examiner*—Clifford D. Crowder

*Attorney, Agent, or Firm*—Arthur J. Hansmann

[57] ABSTRACT

A trencher for digging a trench in the ground and being a mobile trencher including ground wheels and a power drive unit and a trencher boom with a digging chain. The trencher boom is pivotally supported about an axis in the trencher, and the ground wheels are driven traction wheels which are located in axially-offset positions to give optimum support for the trencher and resist the reactive forces of the operation of the trencher chain on the remainder of the trencher, all so that the traction wheels remain firmly on the ground and are not lifted off the ground through the reactive forces created by the trencher boom and its digging chain. A caster wheel is included in the ground wheels and is mounted to be free to caster and to alternatively be restricted relative to the remainder of the trencher for guiding the trencher along a desired line of mobilization.

10 Claims, 4 Drawing Figures

TRENCHER WITH OFFSET DRIVE WHEELS

This invention relates to a trencher for digging a trench in the ground, and, more particularly, it relates to a powered trencher with a chain digger and having powered traction wheels.

BACKGROUND OF THE INVENTION

The prior art is already aware of ground trenchers which are mobilized and thus move along the ground while a trencher boom is vertically positioned for digging into the ground and forming the trench therein. These prior art trenchers commonly include ground wheels for mobilizing the trencher and they include a type of powered drive, such as a gasoline engine, for powering the digging chain and for driving traction wheels or other means which induce movement or which mobilize the entire trencher. One example of one type of prior art trencher is seen in U.S. Pat. No. 2,997,276 wherein there are three ground wheels and there is a winch for pulling the trencher along the desired ground line while the digging chain enters the ground and forms the trench and a side-mounted auger moves the dug-up ground away from the trench.

The present invention is concerned with the mobilized support and balance and reactive forces of the trencher, and it will of course be understood that when the trencher chain is digging in the ground, the chain creates a reactive force on the remainder of the trencher, and the ground-supporting wheels should resist that reactive force in order to have the trencher remain upstanding and steerable along the desired trench line on the ground. That is, in the prior art trenchers, the force of the digging chain on the remainder of the trencher is commonly sufficient to cause one or more of the trencher traction wheels to be urged upwardly and lose traction and impair the stability and the steering of the trencher along the ground. In those undesirable instances relative to the prior art trenchers, the operator must endeavor to resist the reactive force by holding on to handle bars or the like in order to prevent the trencher from tipping over or at least prevent the traction ground wheel from losing traction with the ground. In prior art trenchers where the operator must hold the trencher against the aforesaid reactive forces, the steering of the trencher is a problem, and the trencher boom and chain tend to bind in the trench, due to the tipping tendency and the steering problem.

Accordingly, in the present invention, the aforesaid problem is recognized and identified, and the solution to the problem is in the provision of a trencher which overcomes the aforesaid traction, tipping, steering, and like concerns experienced with the prior art trenchers.

Specifically, the present invention is an improvement upon the prior art trenchers in that it has recognized the aforesaid problems, and the present invention provides a trencher which has offset traction wheels disposed in the optimum position on the trencher for the purpose of mobilizing, ground driving, steering, and totally balancing the trencher. In accomplishing these objectives, the trencher of the present invention arranges the traction wheels in axially offset positions, and a releasable type of caster wheel is also provided all for accomplishing the aforesaid objectives and overcoming the problems of the prior art. In doing so, the attention, effort, and skill normally required from the operator are all reduced and the trencher can be operated in a rapid manner and with a most desirable formation of a trench.

Other objects and advantages will become apparent upon reading the following description in the light of the accompanying drawings.

DETAILED DESCRIPTION OF THE PREFERRED EMBODIMENT

Figure 1:
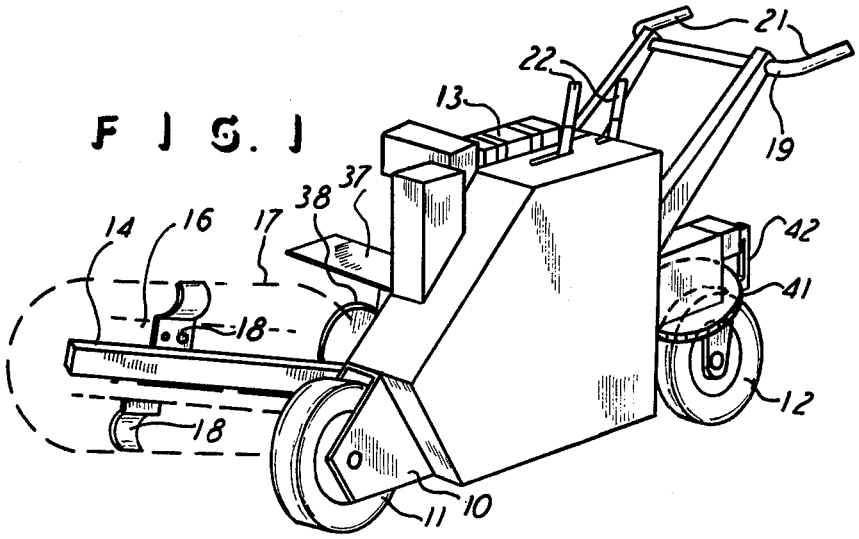
FIG. 1 shows a preferred embodiment of a trencher incorporating the present invention.

The drawings show the trencher of this invention, and it will be seen and understood, by anyone skilled in the art, that the trencher includes a guard and body or frame 10 and ground wheels 11 and 12 and a powered unit 13, which may be in the form of a conventional gasoline engine. The trencher also includes the usual trencher boom 14 having the endless digging chain 16 extending therearound, as indicated by the dotted line 17 and by the two teeth 18, of which there would be a number extending along the dotted indication 17 for the remainder of the chain 16, all in a conventional arrangement of a boom 14 with its chain 16. Also, the trencher includes operator handlebars 19 which the operator can grasp at the handles 21 and thus steer and guide the trencher in its movement along the ground. Of course power control levers 22 are also shown and they may control the operation of the usual raising and lowering of the trencher boom 14 and also the digging action of the trencher chain 16, while the trencher is moving along the ground, in a manner explained hereinafter.

Figure 2:
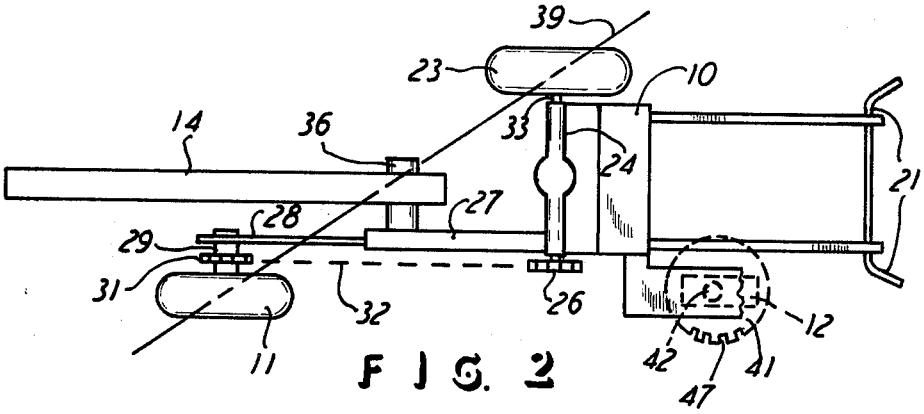
FIGS. 2 and 3 are top and side views, respectively, of fragments of the trencher shown in FIG. 1.

FIG. 2 supplements and/or further shows the trencher body and frame 10, along with the elements mentioned and shown in connection with FIG. 1, and here it will be seen that the trencher actually has three wheels, numbered 11, 12, and 23. Ground wheels 11 and 23 are axially offset relative to each other and of course relative to the fore-and-aft direction of trencher movement, as viewed right and left in FIG. 2. Ground wheel 12 is a caster wheel described more fully hereinafter. Thus, the trencher chassis or frame 10 includes a support or axle housing 24 which rotatably supports the one traction wheel 23 on one side of the trencher, and it rotatably supports a chain sprocket 26 on the other side of the trencher. Also, the ground traction wheel 11 is suitably related and supported on the trencher chassis or frame 10, such as by the extending arms 27 and 28 which may be affixed and rigid frame or chassis members arranged in any conventional manner for the purpose of locating the traction wheel 11 offset from the traction wheel 23, as shown. Thus, the traction wheel 11 has an axle 29 rotatably supported by the frame member 28 and carrying a sprocket 31 which is in a one-to-one driving relation with the sprocket 26 through a conventional sprocket-type chain indicated at 32 by the dotted line. It will therefore be understood that there is a sprocket drive from the rotatably mounted axle 33 in the axle housing 24, and thus the traction wheel 23 and the sprocket 26 rotate in unison, and accordingly then the sprocket 31 and the traction wheel 11 rotate according to the powered drive and rotation of the traction wheel 23. Therefore, the traction wheels 11 and 23 are driven in unison in a one-to-one relation in the mobilizing of the trencher. Of course the powered unit 13 is conventionally drivingly connected with the axle 33, such as through the axle housing 24 in a conventional arrangement and in any manner which will be readily understood by one skilled in the art.

That is, it will be seen and understood that the ground wheels 11 and 23 are driven by a prime mover or the powered unit 13, and the operator can guide or steer the entire trencher through the control of the handles 21, and the caster wheel 12 will assist in the balancing of the trencher and in the control and steering desired.

Figure 3:
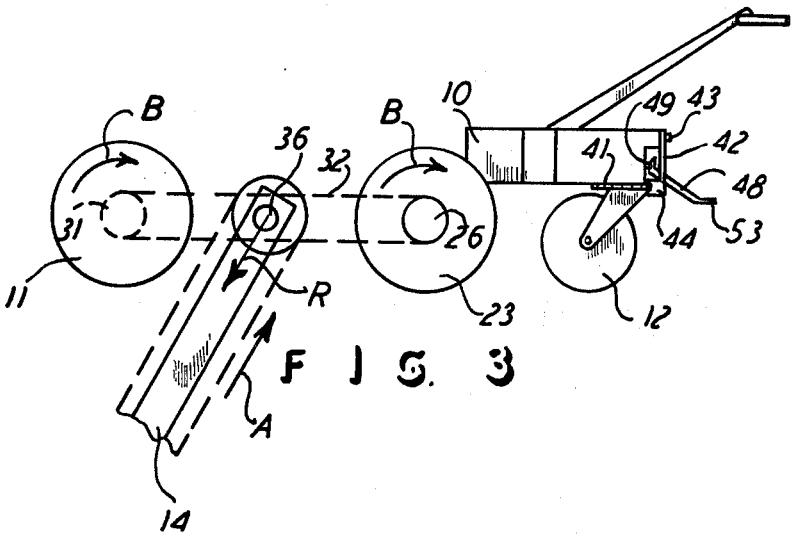

FIG. 2 further shows that the trencher chassis includes a pivot member 36 supported on the arm 27 and on which the boom 14 is pivotally mounted. Thus the boom 14 pivots in a vertical plane to swing up and down and to thereby be lowered to the ground and ultimately to a position such as shown in FIG. 3 when the trencher is operating to form the trench in the ground. Accordingly, the operator will have control over the up-and-down pivotal movement of the boom 14 to have the boom engage the ground and form the trench therein, all in a conventional manner. Further, the persons skilled in the art will understand that the trencher chain 16 will dig in the direction of the arrow A shown in FIG. 3 and thus cause the dirt to be drawn back toward the trencher and in the area of the enclosure 37 wherein there is a conventional and short auger 38 for moving the dirt away from the line of the dug trench and to one side thereof, such as shown by the short auger in the aforesaid U.S. Pat. No. 2,997,276. In that digging operation, FIG. 3 further shows arrows designated B relating to the traction wheels 11 and 23 and showing the direction in which those wheels are powered or driven when the trencher is being operated to form the trench. Thus, the trencher actually moves toward the handlebar 19 so that the trench can be formed from the left to the right, relative to FIGS. 1, 2, and 3. In that digging action mentioned, the action of the trencher chain 16 relative to the forces required for driving the chain to perform the digging, create a reactive force on the trencher which normally causes the trencher to rise off the ground on the side where the sprocket 26 is located. Thus, if the trencher were provided only with the traction wheel 23 and another traction wheel on the axis of the wheel 23, that is in the location of the sprocket 26, then that traction wheel at the sprocket 26 would tend to lift off the ground and would fail in its desired function for driving the trencher along the ground and for supporting the trencher in an upright position on the ground. Accordingly, the present invention arranges for the location of the traction wheel 11 offset from the traction wheel 23, as shown in the drawings. Specifically, the location of the traction wheel 11 is such that the plane or line designated 39 extends to intersect the axes of the wheel 11 and 23 and to also intersect the axis and pivot support 36 for the boom 14. With that arrangement, the reactive force of the boom 14 on the remainder of the trencher is countered by the traction wheels 11 and 23 and the tendency for the trencher to tip is overcome. Accordingly, the traction wheels 11 and 23 are located on opposite sides of a line or vertical plane extending coincident with the axis of pivot of the boom 14, and with that offset of the wheels 11 and 23 being relative to the fore-and-aft direction of the trencher, as indicated and mentioned above. Also, the drawings clearly show that the traction wheels 11 and 23 are disposed laterally of the longitudinal vertical plane of the boom 14, that is, the wheels 11 and 23 are on opposite sides of the plane of pivot of the boom 14.

The drawings further show that the ground wheel 12 is a caster wheel which may be disposed in either a free position for castering or in a fixed position for steering relative to the remainder of the trencher. Accordingly, the wheel 12 is secured with a tooth plate 41 which is rotatable about a pin 42 supported off the trencher chassis or frame 10. Thus, rotation of the plate 41 will cause the castering or steering action of the ground wheel 12. A spring arm 42 is suitably attached by a bolt 43 to the trencher frame 10, and the lower end 44 of the arm 42 carries a tooth 46 which engages the tooth openings 47 formed along the circumference of the plate 41. Thus, in the normal position for the spring arm 42, the arm tooth 46 engages the teeth of the plate 41 and holds the plate 41 against rotation and thus the caster wheel 12 is held in a secure or fixed position, when desired. Of course that position may be any angled position for having the wheel 12 in a steered position, since the plate 41 and consequently the wheel 12 can rotate in a full circle about the mounting rotation pin 42.

Figure 4:
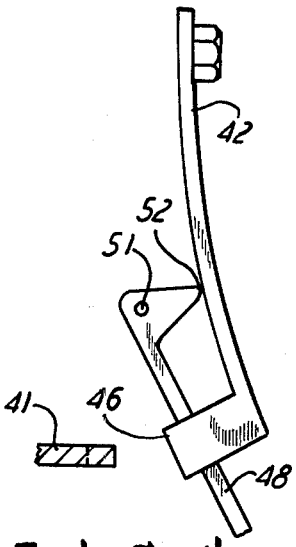
FIG. 4 is an enlarged side elevational view of a fragment of the trencher elements, such as that seen in FIG. 3.

A pedal-operated release arm 48 is suitably pivotally mounted on the frame by means of a support 49 and a pin 51 extending through the frame support 49. Thus, the arm 48 can be pivoted from the FIG. 3 position to the FIG. 4 position where the arm projection or cam portion 52 will engage the spring arm 42 and move its tooth 46 out of engagement with the plate 41, as shown in FIG. 4. To do this, a pedal pad 53 is on the end of the arm 44 and the operator can depress the pad 53 to achieve the released position shown in FIG. 4. Movement of the arm 48 beyond the FIG. 4 position will create an over-center position for the cam 52 relative to its pin 51, and thus the released position will be retained by the parts themselves and until manually released.

Accordingly, the plate 41 provides a swivel mounting member for the caster wheel 12, and the spring arm 42 is a releasable member engagable with the swivel mounting member 41 for releasably securing the member 41 in a non-castering mode. Also, the teeth 46 and 47 are engagable interconnecting portions which achieve the non-castering mode and which are relaqsable for the free castering mode or action for the ground wheel 12. It will be further noticed that the three ground wheels 11, 12, and 23 are on three different axes and thus provide a stable and three-wheel support for the trencher and are shown in FIG. 2 to be at the respective corners of an imaginary triangle of which line 39 forms one side. FIG. 2 also shows that the location of the pivotal support of the boom 14 on the chassis member 36 is within the geometric limits of that imaginary triangle. Therefore, the reactive force of the boom chain 16 on the trencher, such as in the downward direction shown by the arrow R in FIG. 3, will be resisted by the location of the traction wheels 11 and 23, in the manner shown in the drawings and as described in the aforesaid.

What is claimed is:

1. In a trencher for digging a trench in the ground, a mobile trencher including three ground wheels and a powered drive unit and a trencher boom with a digging chain thereon and driven by said drive unit, said trencher boom being pivotally supported about an axis and as an element of said mobile trencher and extending to a free end for penetrating the ground and forming the trench in the ground and with said chain being driven along the length of said boom for digging into the ground, two of said ground wheels being drivingly associated with said drive unit to be traction wheels and to drivingly support said mobile trencher in a fore-and-aft direction of movement, the improvement comprising all of said wheels being located on separate and respective axes offset from each other in the fore-and-aft direction of said mobile trencher and with said two traction wheels being disposed on opposite sides of said trencher and with said three wheels being located at the respective corners of an imaginary triangle in plan view of said trencher, said trencher boom being pivotally supported on a pivot axis located to intersect a vertical plane extending between the said two traction wheels and said trencher boom being pivotally supported at a location within the geometric limits of said imaginary triangle, whereby the forces of said trencher boom on said mobile trencher are neutralized through the location of said two traction wheels.

2. The trencher with offset drive wheels as claimed in claim 1, including a chain drive operatively connected between said two traction wheels, for driving said two traction wheels in unison.

3. The trencher with offset drive wheels as claimed in claim 1, wherein said two traction wheels are drivingly rotated by said powered drive unit in one direction of rotation for advancing said mobile trencher along the ground while a trench is being dug, and said chain being driven by said powered drive unit in the direction opposite said one direction, whereby the reactive forces of said chain on said mobile trencher are resisted by the force of said two traction wheels on the ground.

4. The trencher with offset drive wheels as claimed in claim 1, wherein said ground wheels include a caster wheel steeringly connected in said mobile trencher for steeringly guiding said mobile trencher on the ground.

5. The trencher with offset drive wheels as claimed in claim 4, including a swivel mounting member for said caster wheel for steering directions of said caster wheel, and a releasable member engagable with said swivel mounting member for releasably securing said swivel mounting member in a non-castering mode.

6. The trencher with offset drive wheels as claimed in claim 5, wherein said swivel mounting member and said releasable member have engagable interconnecting portions, and with said releasable member being mounted in said mobile trencher in a fixed arrangement for the securing of said swivel mounting member in the non-castering mode when said interconnecting portions are engaged.

7. The trencher with offset drive wheels as claimed in claim 6, including a foot pedal operatively associated with said releasable member for positioning said releasable member and consequent engagement and disengagement of said interconnecting portions.

8. The trencher with offset drive wheels as claimed in claim 1, wherein one of said two traction wheels is disposed laterally of said trencher boom and rearwardly of the axis of pivot of said trencher boom, relative to the digging direction of travel of said mobile trencher.

9. The trencher with offset drive wheels as claimed in claim 8, wherein said two traction wheels are located to have a straight line extend therebetween and across the axis of pivot of said trencher boom and said straight line is one side of said triangle.

10. The trencher with offset drive wheels as claimed in claim 9, wherein said ground wheels include a non-traction wheel which is located offset from and in the forward direction of the axes of said two traction wheels relative to the direction of digging movement of said mobile trencher.

* * * * *